United States Patent [19]

Hasegawa et al.

[11] 3,966,471

[45] June 29, 1976

[54] ELECTRO PHOTOSENSITIVE MATERIALS WITH A PROTECTIVE LAYER

[75] Inventors: Haruo Hasegawa; Hiroyoshi Taniguchi; Shiro Yamane; Takao Igawa; Tomoshi Nagayama, all of Tokyo, Japan

[73] Assignee: Ricoh Co., Ltd., Tokyo, Japan

[22] Filed: Dec. 26, 1974

[21] Appl. No.: 536,296

[30] Foreign Application Priority Data

Dec. 25, 1973 Japan ..... 49-4025

[52] U.S. Cl. ..... 96/1.5; 96/1.8

[51] Int. Cl.[2] ..... G03G 5/04; G03G 5/08

[58] Field of Search ..... 96/1.5, 1.8, 67, 85, 96/86 R, 87 R, 87 A

[56] References Cited

UNITED STATES PATENTS

| | | | |
|---|---|---|---|
| 3,501,294 | 3/1970 | Joseph | 96/1.5 |
| 3,650,737 | 3/1972 | Maissel et al. | 96/1.5 |
| 3,847,606 | 11/1974 | Schwartz et al. | 96/1.5 |
| 3,850,632 | 11/1974 | Hukase et al. | 96/1.5 |
| 3,867,143 | 2/1975 | Tanaka et al. | 96/1.5 |
| 3,874,942 | 4/1975 | Negishi et al. | 96/1.5 |

*Primary Examiner*—Jack P. Brammer

*Attorney, Agent, or Firm*—Cooper, Dunham, Clark, Griffin & Moran

[57] ABSTRACT

A photosensitive material comprising a conductive support provided with a photoconductive layer and a protective layer, wherein the protective layer contains an organic aluminum compound.

2 Claims, No Drawings

ELECTRO PHOTOSENSITIVE MATERIALS WITH A PROTECTIVE LAYER

BACKGROUND OF THE INVENTION

1. Field of the Invention

The present invention relates to novel photosensitive materials having an improved protective layer.

2. Description of the Prior Art

The electrophotographic process generally comprises the steps of imposing a uniform positive or negative charge on a photoconductive layer formed on a conductive support, conducting imagewise exposure to thereby form an electrostatic latent image, developing the latent image with a developer prepared by dispersing toner particles in a proper carrier (gas, liquid or solid), and in the case of the indirect electrophotographic process, transferring the image formed on the surface of the photosensitive material onto a transfer material such as an ordinary paper, etc., and then fixing the transferred image by applying heat or by virtue of the self-fixability of the toner.

With this method, the photosensitive material, after transfer of image, has residual toner on the photoconductive surface. Therefore, the surface must be cleaned with a brush or the like before reusing the material. As a result, the photoconductive layer of the photosensitive material may become damaged.

This damage manifests itself as flaws in the transferred image, which tend to become more apparent with repeated uses of the photosensitive material.

To avoid this damage, the photosensitive material should be made more durable. One known method for dealing with the problem is to provide a protective layer on the photoconductive layer.

A wide variety of materials have been previously employed to form protective layers. These have included, for example, such resins as polystyrene, poly-n-butyl methacrylate, polyamide, polyester, polyurethane, polycarbonate, polyvinyl formal, polyvinyl acetal, polyvinyl butyral, ethyl cellulose, nitrocellulose and cellulose acetate.

In indirect electrophotography, in order to enhance the concentration of the transferred image and to facilitate the cleaning of the residual toner left on the surface of the photosensitive material, the toner image on the surface of the photosensitive materal should be transferred as completely as possible to the transfer material such as ordinary paper, etc. That is, the transfer rate must be enhanced as much as possible.

The transfer rate can be expressed by the following equation:

$$\text{Transfer rate} = \frac{D_T - D_R}{D_T}$$

wherein, $D_T$ is the image density or concentration of whole image on the surface of photosensitive material (the concentration of image on the photosensitive material prior to the transfer of an ordinary paper)

$D_R$ is the image density concentration of residual image on the photosensitive material (the concentration of image on the photosensitive material after the transfer to an ordinary paper)

Both $D_T$ and $D_R$ are measured with a photographic densitometer after the image on the photosensitive material has been transferred onto a transparent sheet having its one side coated with an adhesive.

$D_T - D_R$ is regarded as corresponding to the concentration of image transferred to the transfer material. The concentration of image is proportional to the amount of toner transferred.

A number of attempts have been made with a view to enhancing the transfer rate. These have been directed mainly to the fields of improvements in the developer and the copying apparatus. While some progress has been made, the results are still not completely satisfactory.

SUMMARY OF THE INVENTION

The products of this invention are photosensitive materials manifesting excellent durability and a high transfer rate.

An object of the invention is to provide photosensitive materials having excellent durability. The photosensitive material according to the present invention has a high abrasion resistance and is sufficiently durable to produce more than 10,000 transferred copies.

A further object of the present invention is to provide photosensitive materials having a high transfer rate.

In the case of the conventional photosensitive materials, whether or not they are provided with a protective layer, the transfer rate is normally from 0.3 to 0.7 or thereabouts at the most. In contrast, the photosensitive materials according to the present invention demonstrate a transfer rate of more than 0.7–0.8 when employed under the same conditions with respect to the copying apparatus, developer and transfer material as conventional photosensitive materials.

DETAILED DESCRIPTION OF THE INVENTION

These and other objects of the invention are achieved by providing a protective layer containing an organic aluminum compound on a photoconductive layer formed on an electroconductive support.

The conductive support may be any of a wide variety of conventional materials having conductivity. These may include, for example, aluminum, zinc, brass, copper, tin, nickel, polyvinyl alcohol, etc. or complexes obtained by combining these substances with insulating materials such as paper, plastics, and the like.

The photoconductive layer for use in this invention may also be constructed in accordance with conventional practice and contain either a single photoconductive material or a dispersed system comprising photoconductive material and binder. Typical examples include zinc oxide, titanium oxide, zinc sulfide, selenium, cadmium sulfide, cadmium selenide, N-vinyl carbazole, oxazole, thoriazole, imidazole, bromopylene and derivatives and mixtures thereof. Silicone resins, acrylic resins, alkyd resins, styrene~butadiene copolymers, and the like may be mentioned as typical examples of suitable binders. Sensitizers such as rose bengal may also be added.

To cite instances of the organic aluminum compounds for use in the present invention, there are aluminum alcoholates such as aluminum triisopropylate (I), monosecondary butoxyaluminum diisopropylate (II), aluminum secondary butylate (III), aluminum trimethylate (IV) and aluminum triethylate (V); aluminum chelate compounds such as ethyl acetoacetate aluminum diisopropylate (VI), tris(ethyl acetoacetate) aluminum (VII), Diethyl-4-ethoxybutyl aluminum (VIII); Diethyl [(diethylamino)-3-propyl]aluminum (IX); Dimethyl-4-methoxybutyl aluminum (X); Dimethyl [(dimethylamino)-3-propyl]aluminum (XI); methylaluminum dibromide (XII); methylaluminum dichloride (XIII); diethylaluminum chloride-diethylether complex (XIV); sodium triethylfluoroaluminum (XV) and trimethylaluminum-trimethylphosphine complex (XVI).

$(i\text{—}C_3H_7O)_3Al$ (I)

$(i\text{—}C_3H_7O)_2Al\ (sec\text{-}C_4H_9O)$ (II)

$sec\text{-}C_4H_9O)_3Al$ (III)

$(CH_3O)_3Al$ (IV)

$(C_2H_5O)_3Al$ (V)

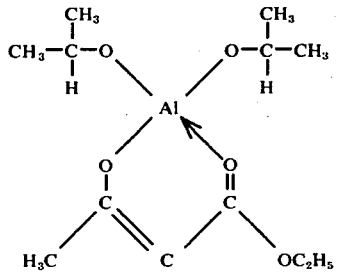

(VI)

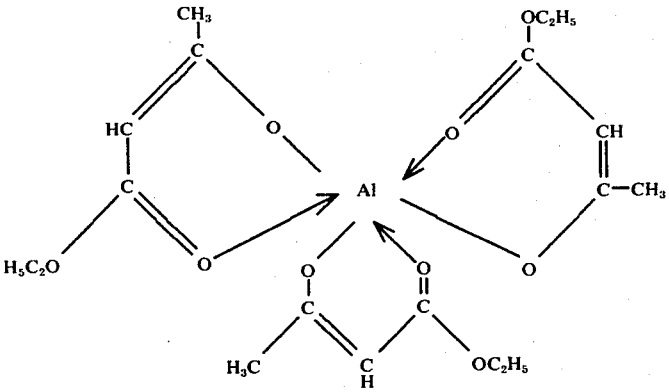

(VII)

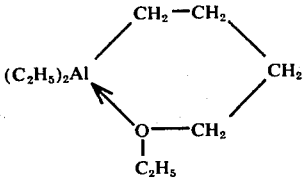

(VIII)

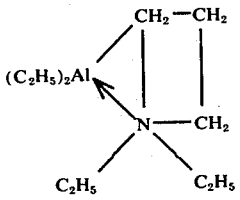

(IX)

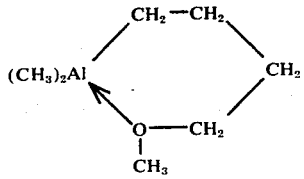

(X)

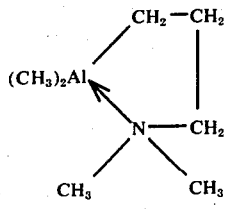

(XI)

$AlCH_3Br_2$ (XII)

$AlCH_3Cl_2$ (XIII)

$(C_2H_5)_2\ AlCl.\ (C_2H_5)_2O$ (XIV)

$Na[(C_2H_5)_3AlF]$ (XV)

$(CH_3)_3AlP(CH_3)_3$ (XVI)

These organic aluminum compounds are used by mixing 0.1–50% by weight, preferably 2–30% by weight, based on the total weight with a resin such as polystyrene, poly-n-butyl methacrylate, polyamide, polyester, polyurethane, polycarbonate, polyvinyl formal polyvinyl acetal, polyvinyl butyral, ethyl cellulose, nitrocellulose and cellulose acetate in the protective layer. These resins are mentioned merely by way of example and are not intended to limit the invention since a wide variety of resins including mixtures of resins which are chemically and physically inert under the conditions of use may be employed.

The photosensitive materials of this invention may also contain inorganic pigments, organic pigments, dyestuffs, etc. in the protective layer to achieve special effects.

The protective layer of the invention may be formed on the photoconductive layer by any of the usual means such as spraying, electrostatic coating, dipping, roller coating, and the like. The dry thickness of the protective layer is desirable to be in the range of 0.1–20 $\mu$.

The excellent durability of the photosensitive materials according to the present invention is attributable to the toughness and high abrasion resistance of the protective layer.

The reason why the photosensitive materials of the invention demonstrate such a high transfer rate is yet to be clarified. While we do not wish to be limited by theory, it appears that the organic aluminum compound reacts with resin and forms a protective layer having a strong resistance against the dry developer as well as wet developer. In other words, it appears that the surface of the photosensitive materials of the invention is quite invulnerable to the dry developer as well as wet developer and does not permit strong or permanent adhesion of the developers. As a result, the transfer rate is much improved over conventional developers.

DESCRIPTION OF THE PREFERRED EMBODIMENTS

EXAMPLE 1

By depositing amorphous selenium through vacuum evaporation on an aluminum plate, a 50 μ-thick photoconductive layer was formed.

A solution prepared by dissolving 10 g of polyvinyl butyral (S-lec BL-1, SEKISUI KAGAKU K. K.) in 40 g of isopropyl alcohol was thoroughly mixed by stirring with another solution prepared by dissolving 4 g of monosecondary butoxyaluminum diisopropylate in 36 g of ethyl alcohol. Subsequently, the resulting mixture solution was coated on the foregoing photoconductive layer by the roller coating method and dried with warm air at 40°C to form a 3 μ-thick protective layer, whereby a photosensitive material (No. 1) was prepared.

For comparative testing, a photosensitive material (No. 2) not provided with a protective layer and another photosensitiver material (No. 3) provided with a 3 μ-thick conventional protective layer consisting exclusively of polyvinyl butyral were prepared.

When the transfer rates of these 3 types of photosensitive materials were measured by the use of an indirect electrophotographic tester equipped with mechanism for charging, imagewise exposure, developement (by the magnetic brushing method employing a dry developer prepared by using iron powder as the carrier), transfer and cleaning (The fixing of the transferred image was performed by the use of a separate thermofixing apparatus.), the results were as shown in the following Table 1. The developer and the transfer material (an ordinary paper was used) were the same in each case, and the atmosphere was about 20°C in temperature and 65% in RH. (The same conditions for test as above will apply hereinafter unless otherwise specified.)

Table 1

| Sample Photosensitive Material | Transfer Rate | Remarks |
|---|---|---|
| No. 1 | 0.86 | According to the present invention |
| No. 2 | 0.62 | According to the conventional method |
| No. 3 | 0.53 | According to the conventional method |

The photosensitive material of this invention displayed a high transfer rate, the transferred image was high in concentration and distinct, and the cleanability of the residual toner from the surface of the photosensitive material was very satisfactory. Further, when these three photosensitive materials were exposed to the atmosphere at 30°C and 90% RH for 4 hours and thereafter the image was formed and tested as described above, photosensitive materials No. 1 and No. 3 produced satisfactory images, but the photosensitive material No. 2 produced a greatly blurred image and was unfit for practical use.

EXAMPLE 2

Upon adding the whole amount of a solution prepared by dissolving 8 g of tris (ethyl acetoacetate) aluminum in 50 g of toluene and then adding 1 g of silicone oil (KF56, SHINETSU KAGAKU KOGYO K. K.) to 100 g of a toluene solution of copolymer resin containing 96 moles of n-butyl methacrylate and 4 moles of acrylic acid and containing 40% of non-volatile matter, followed by thorough mixing by stirring, the resulting mixture solution was coated on the same photoconductive layer as that in Example 1 by the roller coating method and air dried to form a 1 μ-thick protective layer, whereby a photosensitive material (No. 4) was prepared.

For comparison, another photosensitive material (No. 5) provided with a 1 μ-thick protective layer consisting exclusively of n-butyl methacrylate~acrylic acid copolymer resin was prepared.

When the transfer rates of these photosensitive materials were measured by the use of the same tester as that in Example 1, it was only 0.52 for material No. 5, and the contrast of the transferred image was insufficient. In contrast, photosensitive material No. 4 of the present invention was as high as 0.92 and the contrast of the transferred image was very satisfactory.

EXAMPLE 3

A dispersion obtained by dissolving 100 g of fine particles of photoconductive cadmium sulfide, 60 g of styrenated epoxide resin solution containing 50% of non-volatile matter (Styresol J725T, DAINIPPON INK KAGAKU KOGYO K. K.) and 50 g of toluene by means of a homogenizer for 10 minutes was coated on a support consisting of a polyester film which had been coated with aluminum by vacuum evaporation and dried to form a 35 μ-thick photoconductive layer.

A solution prepared by dissolving 1.5 g of ethyl acetoacetate aluminum diisopropylate in 20 g of methanol was thoroughly mixed by stirring with another solution prepared by dissolving 10 g of polyamide resin (Elvamid 8061, Du Pont Co., U.S.A.) in 90 g of methanol. Subsequently, the resulting mixture was coated on the foregoing photoconductive layer by the blade coating method and dried at 80°C for 10 minutes to form a 5 μ-thick protective layer, and form a photosensitive material (No. 6).

When the transfer rate of this photosensitive material No. 6 was measured as in Example 1 (except for reversing the polarity of toner and the polarity of charged electricity), it was 0.86. When the transfer rate of another photosensitiver material (No. 7) provided with a 5 μ-thick protective layer consisting exclusively of polyamide resin, and prepared by the conventional method was measured under the same conditions, it was only 0.47.

When the photosensitiver materials No. 6 and No. 7 were exposed to the atmosphere at 30°C and 90% RH for 4 hours and thereafter used for the formation of images and testing was effected the image formed with photosensitive material No. 7 was very greatly blurred and was unfit for practical use.

The photosensitive material No. 6 could be used in the formation of a very satisfactory image. It is evident from these tests the photosensitive materials of the present invention have improved wet-proof properties since they can be satisfactorily employed after exposure to conditions of high humidity.

EXAMPLE 4

By coating a solution prepared by dissolving 10 g of polyvinyl carbazole, 12 g of 2,4,7-trinitro-9-fluorenone and 4 g of polycarbonate in 250 g of tetrahydrofuran onto a hollow cylindrical aluminum support measuring 300 mm in length, 150 mm in outside diameter and 4 mm in thickness by the spray method and then drying at 120°C for 12 minutes, a 14 μ-thick photoconductive layer consisting of organic photoconductor was formed.

Subsequently, by coating a solution prepared by mixing 100 g of a phenol resin solution (Plyophen 5010, DAINIPPON INK KAGAKU KOGYO K. K., which is an ethyl alcohol solution containing 58% resin) with 200 g of a 10% ethyl alcohol solution of tris (ethyl acetoacetate) aluminum by the spray method and drying at 100°C for 5 minutes to form a 6 μ-thick protective layer, an electrophotographic sensitive material (No. 8) was prepared.

For comparison, a photosensitive material (No. 9) not provided with any protective layer and a photosensitive material (No. 10) made by applying the same conditions as that in Example 4 save for employing phenol resin alone in forming the protective layer were prepared.

When the transfer rates and the durability of these photosensitive materials were examined by means of an ordinary paper copying equipped with a mechanism for repeating the charging, exposure, development (by the use of a wet developer prepared by dispersing the toner in kerosene employed as the carrier), transfer (by the use of a prescribed ordinary paper as the transfer material) and cleaning (by the use of a blade cleaner), the results were as shown in the following Table 2.

Table 2

| Sample Photosensitive Material | Transfer Rate | Durability (in terms of number of copies) | Remarks |
|---|---|---|---|
| No. 8 | 0.89 | 30,000 copies | According to the present invention |
| No. 9 | 0.56 | 2,000 copies | According to the conventional method |
| No. 10 | 0.52 | 25,000 copies | According to the conventional method |

With photosensitive material No. 8 of this invention, the transfer rate was high so that the concentration of the transferred image was also high, and the cleanability of the surface of the photosensitive material was very satisfactory. The image obtained showed very little background staining, and was distinct with high contrast. Moreover, the material displayed an excellent durability.

When the photosensitive materials No. 8 and No. 10 were exposed to an atmosphere at 30°C and 90% RH for 4 hours and tested as described above, photosensitive material No. 10 manifested a greatly blurred image and the letters therein were illegible, while the photosensitive material No. 8 showed a very distinct image.

Further, a wet developer was prepared by employing 20 g of Crystal Violet as the toner and dissolving and dispersing this toner in 3l of distilled water as the carrier. When this wet developer was put in the same copying machine as in Example 4 and the forming of image was effected by the use of the photosensitive material No. 8 and an ordinary paper as the transfer material, there was obtained a very distinct image free of background stains.

What is claimed is:

1. A photosensitive material comprising a conductive support at least one surface of which is coated with a photoconductive layer, the said photoconductive layer in turn being coated on the top surface thereof with a protective coating comprising from 0.1 to 50% by weight based on the total weight of the protective coating with an organic compound selected from the group consisting of aluminum alcoholates and aluminum chelate compounds dispersed in a resin.

2. A photosensitive material according to claim 1, wherein the thickness of the protective layer is from 0.1–20 μ.

* * * * *